US011891231B1

(12) United States Patent
McCormack et al.

(10) Patent No.: US 11,891,231 B1
(45) Date of Patent: Feb. 6, 2024

(54) CONTROLLED DOSAGE DISPENSING VALVE

(71) Applicant: Hamex Fuel Cell Pvt Ltd, Pune (IN)

(72) Inventors: Rex McCormack, Tairua (NZ); Vinod Kumar Moza, Pune (IN)

(73) Assignee: HAMEX FUEL CELL PVT LTD, Pune (IN)

( * ) Notice: Subject to any disclaimer, the term of this patent is extended or adjusted under 35 U.S.C. 154(b) by 0 days.

(21) Appl. No.: 18/465,830

(22) Filed: Sep. 12, 2023

Related U.S. Application Data

(60) Provisional application No. 63/375,349, filed on Sep. 12, 2022.

(51) Int. Cl.
*G01F 3/36* (2006.01)
*B65D 83/54* (2006.01)

(52) U.S. Cl.
CPC ..... *B65D 83/54* (2013.01)

(58) Field of Classification Search
CPC ..... B65D 83/54
See application file for complete search history.

(56) References Cited

U.S. PATENT DOCUMENTS 6,302,297 B1 * 10/2001 Richardson ..... B25C 1/08 222/402.2
2008/0110953 A1 * 5/2008 Gibson ..... B65D 83/24 429/513
2015/0232259 A1 * 8/2015 Regard ..... G01F 11/32 222/402.2

FOREIGN PATENT DOCUMENTS

JP 2013180802 A * 9/2013 ..... B65D 83/22
JP 2015131681 A * 7/2015
WO WO-2012017556 A1 * 2/2012 ..... B65D 83/207
WO WO-2019202882 A1 * 10/2019 ..... B65D 83/205

* cited by examiner

*Primary Examiner* — Bob Zadeh

(57) ABSTRACT

The controlled dosage dispensing valve is a device that may be placed atop an extraneous cylinder. It is an aim of the device to facilitate the metering and dosing chambers within a plurality of annular aperture and an upper portion of the intake channel respectively through a plurality of fuel apertures. To accomplish this, a spigot valve system, a dosing system, and a cap system are integrated onto a single apparatus that may be fitted over an external gas cylinder. Further, a return spring is disposed that may facilitate vertical reciprocating motion consequent to the consumption of fuel in the associative metering and dosing chambers. With an extraneous tool about the device that induces a downward vertical force on the valve spigot and the pressure of the fuel propagated by the extraneous fuel cylinder, the device achieves the reciprocating motion necessary to meter and dose the fuel.

20 Claims, 10 Drawing Sheets

CONTROLLED DOSAGE DISPENSING VALVE

FIELD OF THE INVENTION

The present invention relates generally to a valve, more particularly a metered valve for fuel cylinders where more particularly the dosing and metering is accomplished exterior to the cylinder.

BACKGROUND OF THE INVENTION

Presently, gas powered tools require the use of a fuel canister or cylinder that is then associated to a valve. However, the dosing and metering operations are conventionally associated to the canister or cylinder which would naturally mean a higher cost for the fuel cylinders. More notably, the nature of a fuel cylinder is to be exhausted upon an arbitrary time of usage, thus requiring both the fuel cylinder cartridge and the metering and dosing mechanisms to simultaneously be disposed of. However, if the dosing and metering is able to be managed exterior to the fuel cylinder, the cost per cylinder is likely to be reduced only requiring a container and a depressible valve.

An objective of the present invention is to introduce a valve system that may be placed atop the extraneous cylinder. Wherein the valve system in association to a valve spigot and an annular retaining plate may facilitate the metering and dosing chambers within a plurality of annular aperture and an upper portion of the intake channel respectively through a plurality of fuel apertures. Further, a return spring is disposed that may facilitate vertical reciprocating motion consequent to the consumption of fuel in the associative metering and dosing chambers. By associating the valve system with an extraneous tool about the valve spigot that induces a downward vertical force on the valve spigot and the pressure of the fuel propagated by the extraneous fuel cylinder, the present invention achieves the reciprocating motion necessary to meter and dose the fuel through the intake protrusion, the valve spigot, and the plurality of fuel apertures without requiring the metering and dosing mechanisms within the extraneous cylinder. Thereby permitting the present invention to be utilized with multiple extraneous fuel cylinders.

SUMMARY

The present invention is a valve system that may be placed atop an extraneous cylinder. It is an aim of the present invention to facilitate the metering and dosing chambers within a plurality of annular aperture and an upper portion of the intake channel respectively through a plurality of fuel apertures. To accomplish this, a spigot valve system, a dosing system, and a cap system are integrated onto a single apparatus that may be fitted over an external gas cylinder Further, a return spring is disposed that may facilitate vertical reciprocating motion consequent to the consumption of fuel in the associative metering and dosing chambers. By associating the valve system with an extraneous tool about the valve spigot that induces a downward vertical force on the valve spigot and the pressure of the fuel propagated by the extraneous fuel cylinder, the present invention achieves the reciprocating motion necessary to meter and dose the fuel through the intake protrusion, the valve spigot, and the plurality of fuel apertures without requiring the metering and dosing mechanisms within the extraneous cylinder. Thereby permitting the present invention to be utilized with multiple extraneous fuel cylinders.

DETAIL DESCRIPTIONS OF THE INVENTION

All illustrations of the drawings are for the purpose of describing selected versions of the present invention and are not intended to limit the scope of the present invention.

Figure 7:
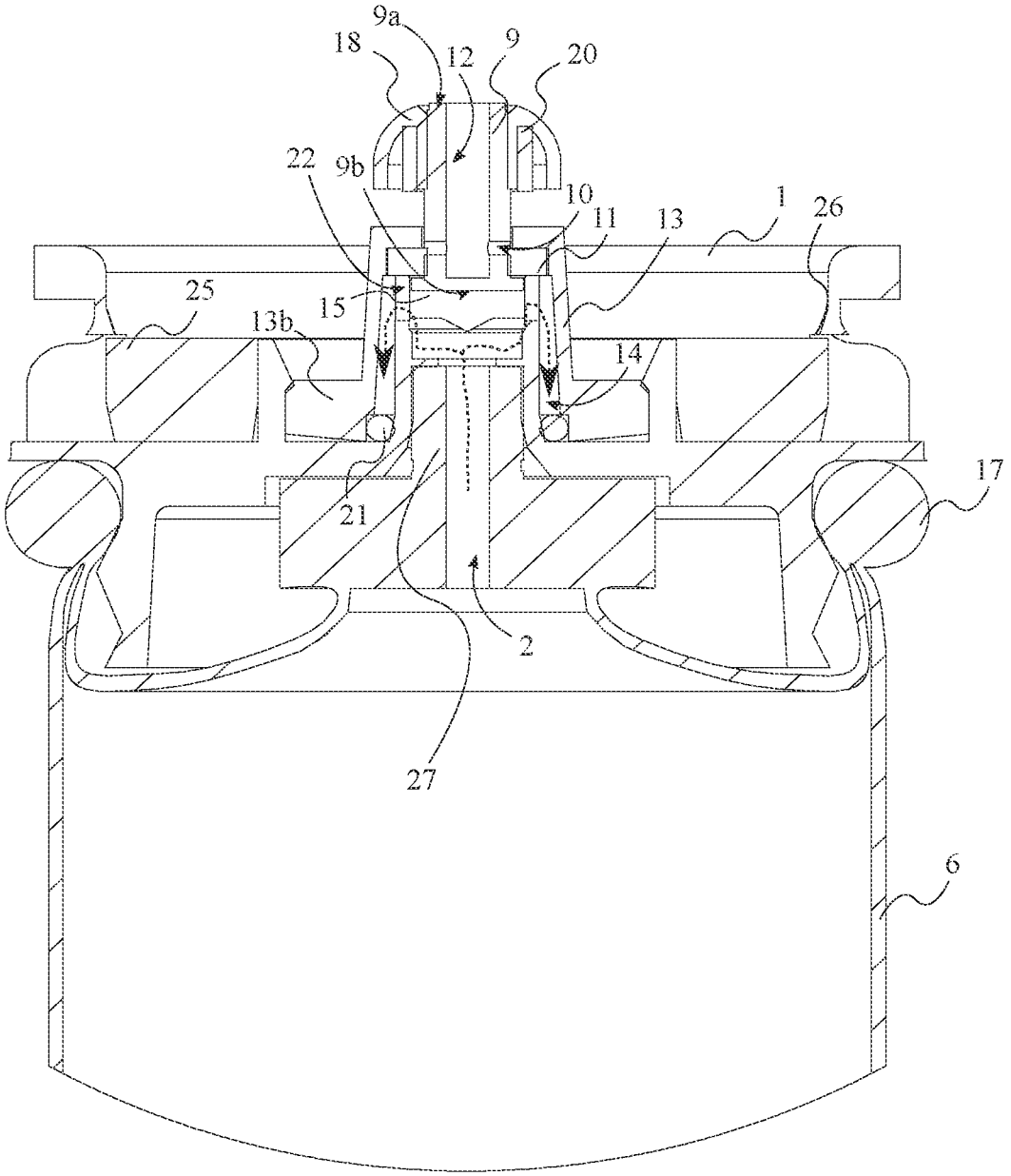
FIG. 7 is a sectional and detailed view of the present invention, wherein broken lines illustrate a path of gas flow when the spigot valve is closed.
Figure 8:
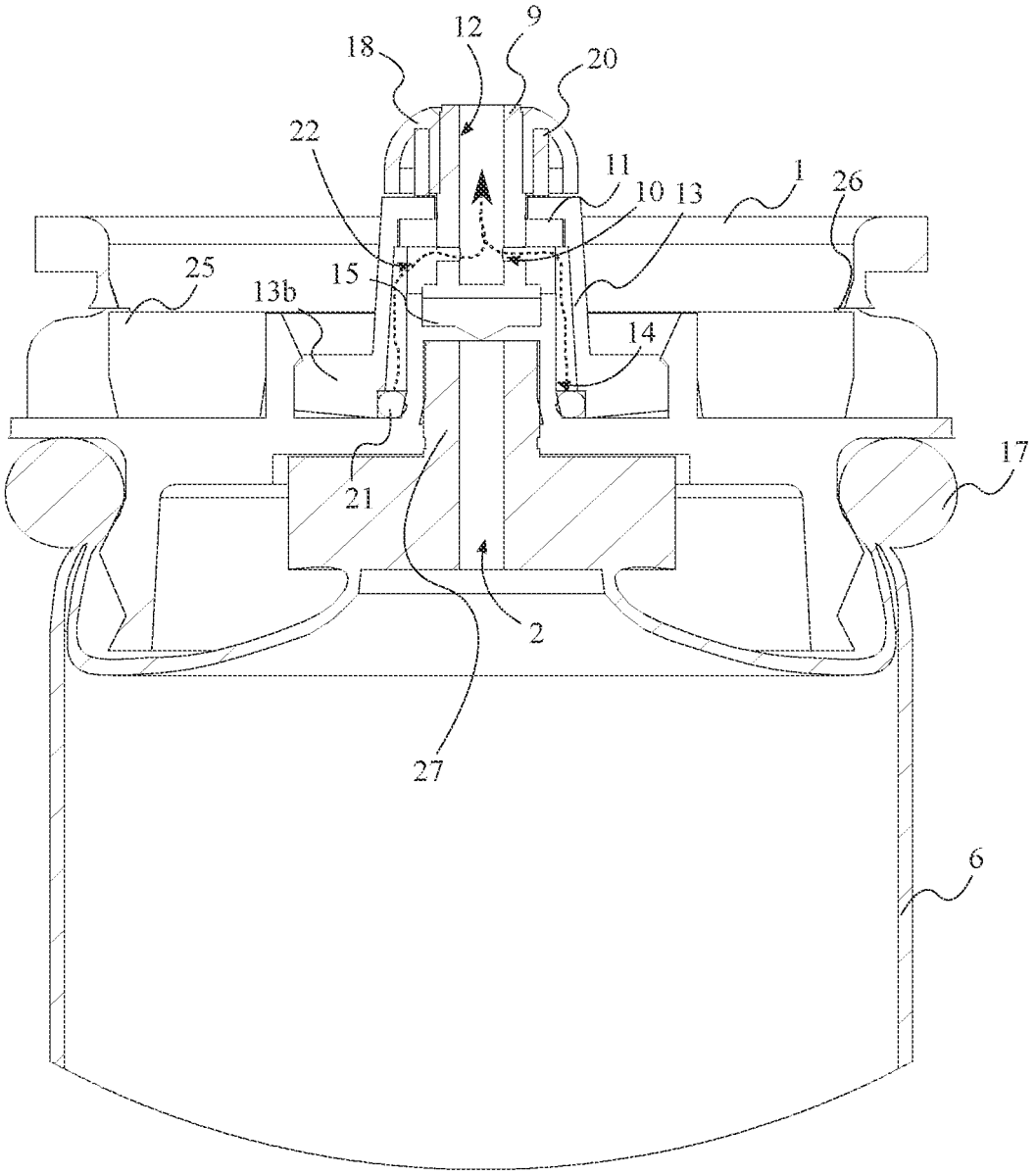
FIG. 8 is a sectional and detailed view of the present invention, wherein broken lines illustrate a path of gas flow when the spigot valve is open.

The following description is in reference to FIG. 1 through FIG. 10. According to a preferred embodiment, the present invention comprises a main valve body 1, an intake channel 2, a cap system 3, a spigot valve system 4, a dosing system 5, and a gas cylinder 6. Preferably, the main valve body 1 is a generally curvilinear body with a top located bowl or centered cavity that is mounted to an extraneous cylinder. The main valve body 1 further supports beneath the spigot valve system 4 and is concentrically aligned therewith preferably. The main valve body 1 further preferably is composed of a homogenous and rigid material such as plastic, metal, or similar. The main valve body 1 comprises an intake protrusion 7, a connecting portion 8, a first end 1*a*, and a second end 1*b*. Preferably, the first end 1*a* is positioned opposite to the second end 1*b* across the main valve body 1. In other words, the first end 1*a* constitutes a top end of the main valve body 1, and the second end 1*b* constitutes a lower end of the main valve body 1. The intake protrusion 7 is centrally positioned along the main valve body 1 and extends opposite to the second end 1*b* of the main valve body 1. The intake protrusion 7 acts as the central structure around which the spigot valve system 4 and the dosing system 5 are mounted. In other words, the spigot valve system 4 and the dosing system 5 are centrally mounted around the intake protrusion 7. As seen in FIG. 7 and FIG. 8, the intake channel 2 traverses centrally through the intake protrusion 7. The intake channel 2 is the main gas flow channel that allows the gas in an extraneous cylinder to traverse through the present invention into an external tool or connector that is connected to a system that utilizes the fuel in the gas cylinder 6. In other words, the gas cylinder 6 is in fluid communication with the intake channel 2. The connecting portion is mounted adjacent to the second end 1*b*, and the connecting portion 8 helps the valve system to connect with the external gas cylinder 6.

Figure 10:
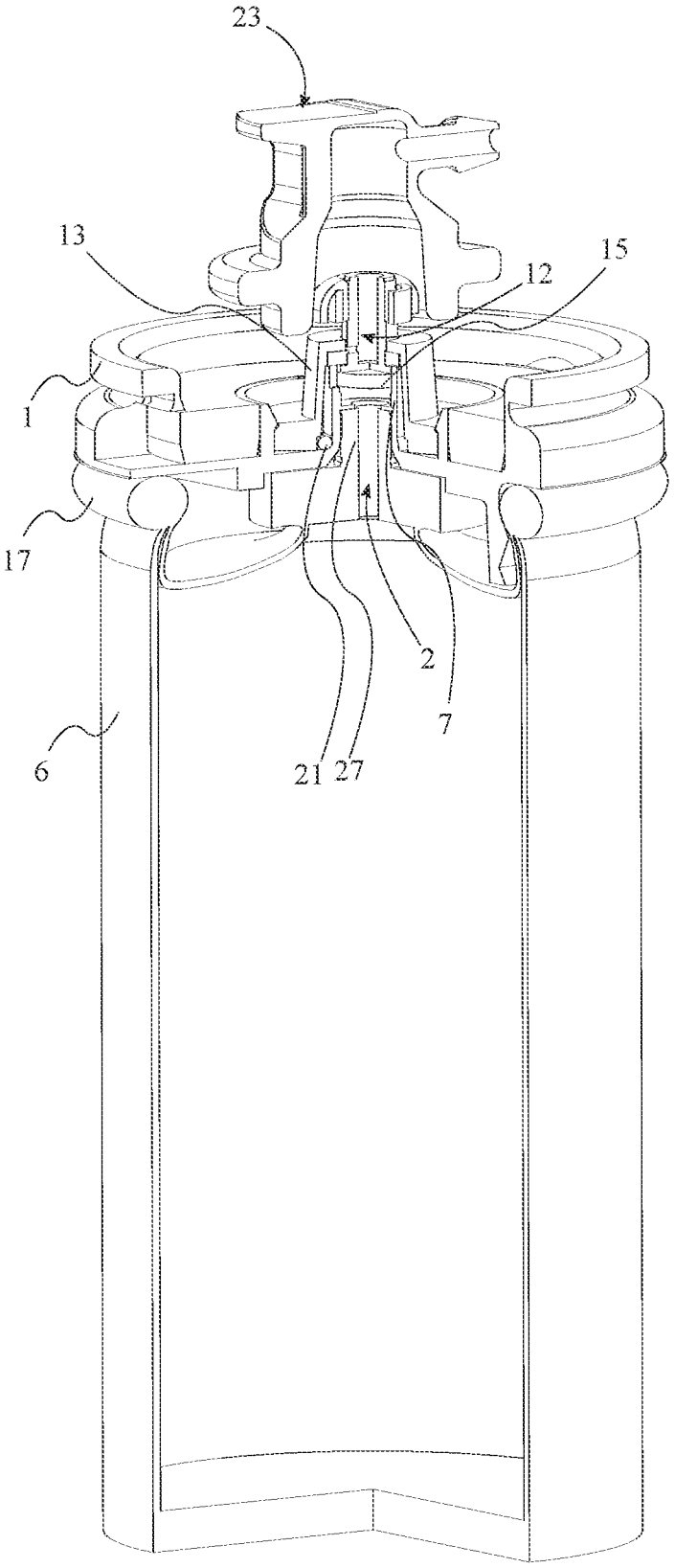
FIG. 10 is a front elevational view, wherein a section of the present invention (including the gas cylinder and the gun actuator) is cut to expose the internal view of the present invention.

It is an aim of the present invention to enable dosing and metering with the help of the spigot valve system 4 and the dosing system 5 associated with the main valve body 1. More specifically, the main valve body 1 is operably coupled with the dosing system 5, wherein manipulating the main valve body 1 enables fluid dosing from the gas cylinder 6 to the dosing system 5. Furthermore, the cap system 3 is operably coupled with the spigot valve system 4 and the dosing system 5, wherein operating the cap system 3 enables the spigot valve system 4 to transition between a closed state and an open state. To enable the smooth functioning of the present invention, the spigot valve system 4 comprises a spigot stem 9, at least one dose release orifice 10, a spigot seal 11, and a spigot gas flow path 12. Preferably, the spigot stem 9 extends above the intake protrusion 7 away from the first end 1*a* of the main valve body 1. Further, the spigot gas flow path 12 centrally traverses through the spigot stem 9, and the dose release orifice 10 laterally traverses through the spigot stem 9. The spigot gas flow path 12 is the path through which gas, after dosing, enters a gas consuming device through an external tool. As seen in FIG. 7, FIG. 8 and FIG. 10, the spigot seal 11 is concentrically wrapped around the spigot stem 9 adjacent to the at least one dose release orifice 10. The dose release orifice 10 is a small circular hole that traverses through the spigot stem 9 and enables gas from the dosing system 5 to escape into the spigot gas flow path 12. According to the preferred embodiment, the dosing system 5 comprises a dose valve body 13, a dose volume chamber 14, and a dose volume seal 15. Preferably, the dose volume chamber 14 is delineated by the area between the dose valve body 13 and the intake protrusion 7. In other words, the dose valve body 13 is wrapped around the intake protrusion 7 in such a way that a small gap or area is left for collected dosing gas. Further, the dose volume seal 15 is operably connected to the spigot system 4 within the intake channel 2, wherein operating the spigot system 4 enables the dose volume seal 15 to close and open the flow of gas from the gas cylinder 6 into the dose volume chamber 14. The gas cylinder 6 is extraneous to the apparatus but ancillary thereof. Preferably, the gas cylinder 6 comprises a fuel therein that is combustive and employed by an extraneous gas or fuel powered tool.

A more detailed description of the present invention follows.

Figure 1:
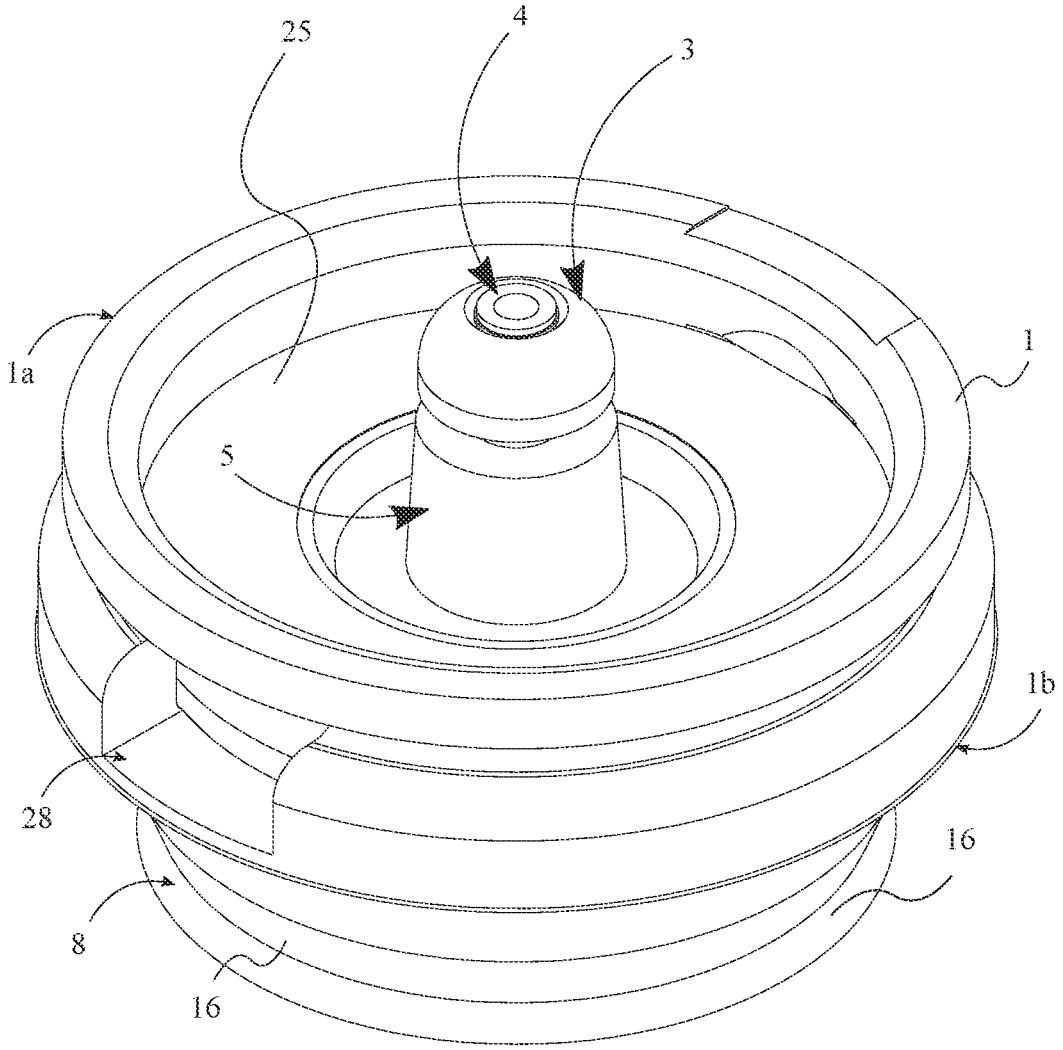
FIG. 1 is a top-front-left perspective view of the present invention. The extraneous cylinder has been omitted.
Figure 2:
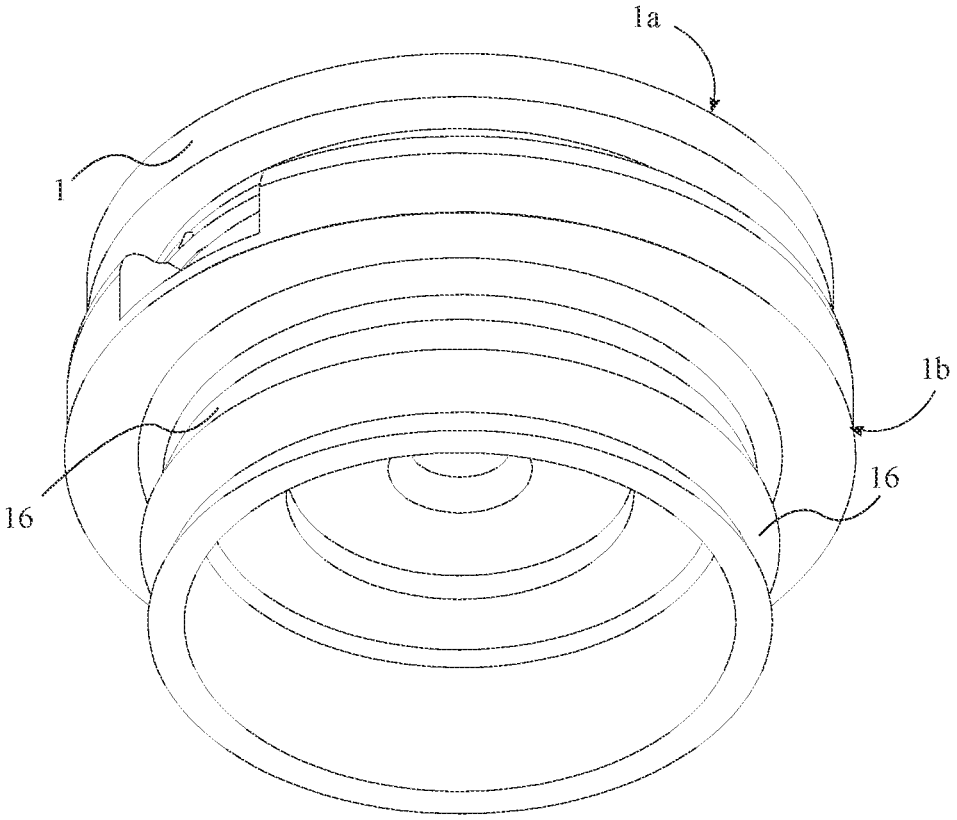
FIG. 2 is a bottom-rear perspective view of the present invention.
Figure 3:
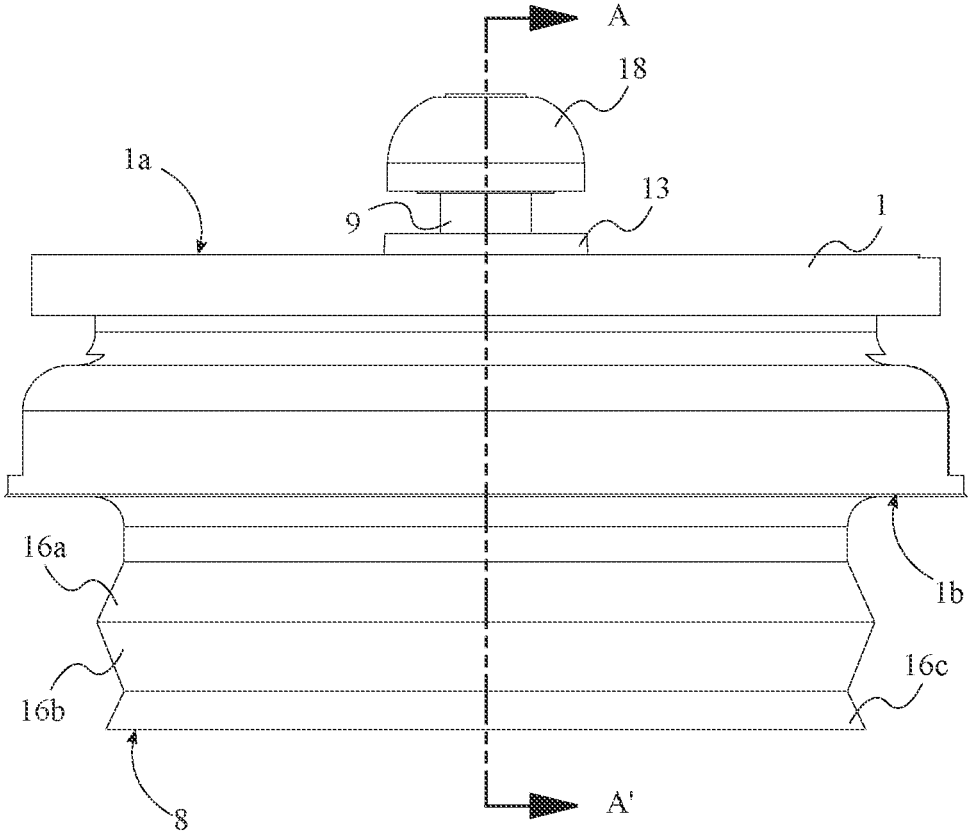
FIG. 3 is a front elevational view of the apparatus thereof.
Figure 4:
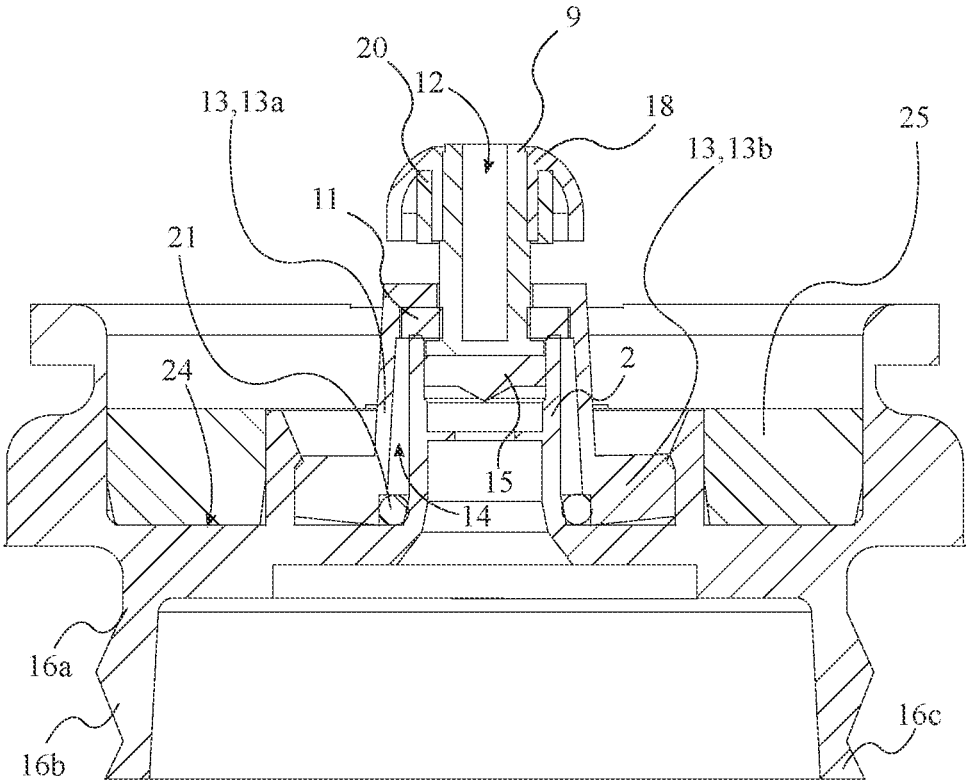
FIG. 4 is a sectional view of the present invention, taken along A-A' of FIG. 3
Figure 5:
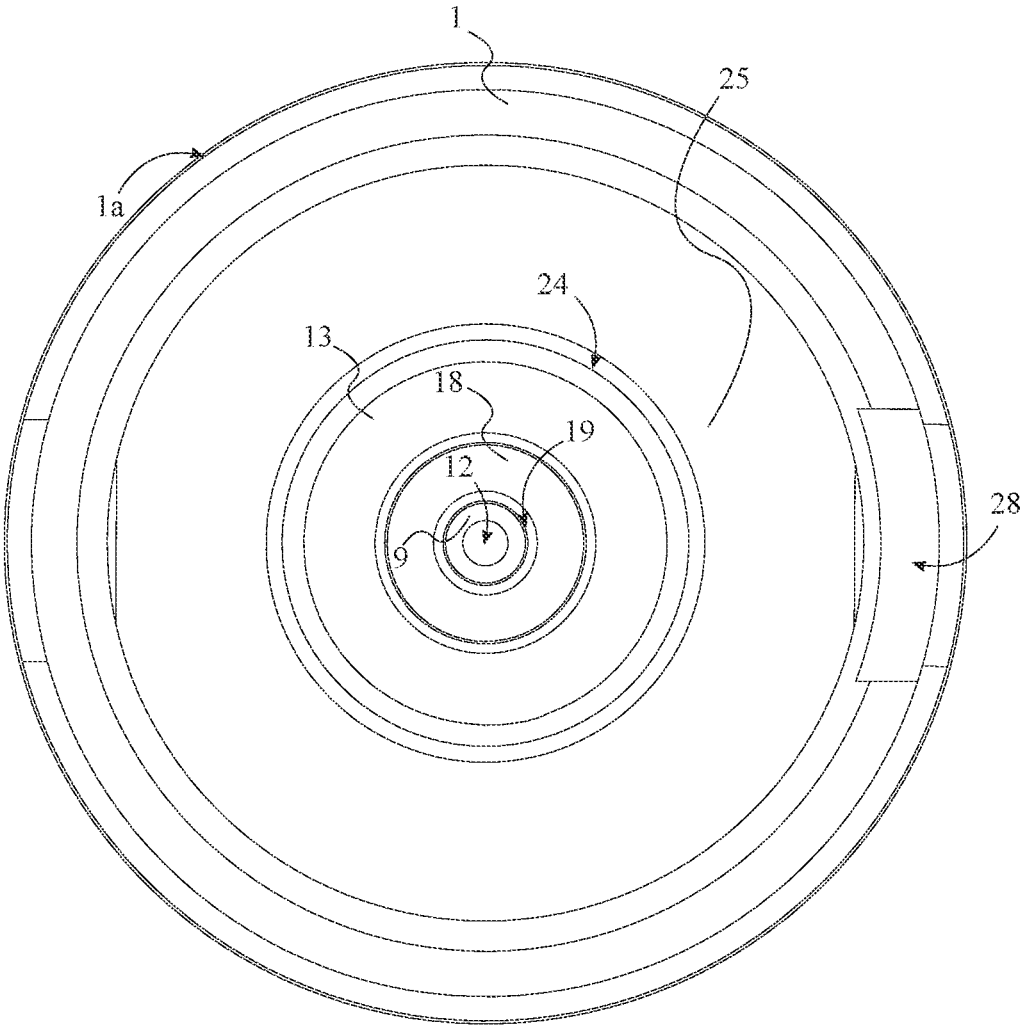
FIG. 5 is a top plan view of the present invention.
Figure 6:
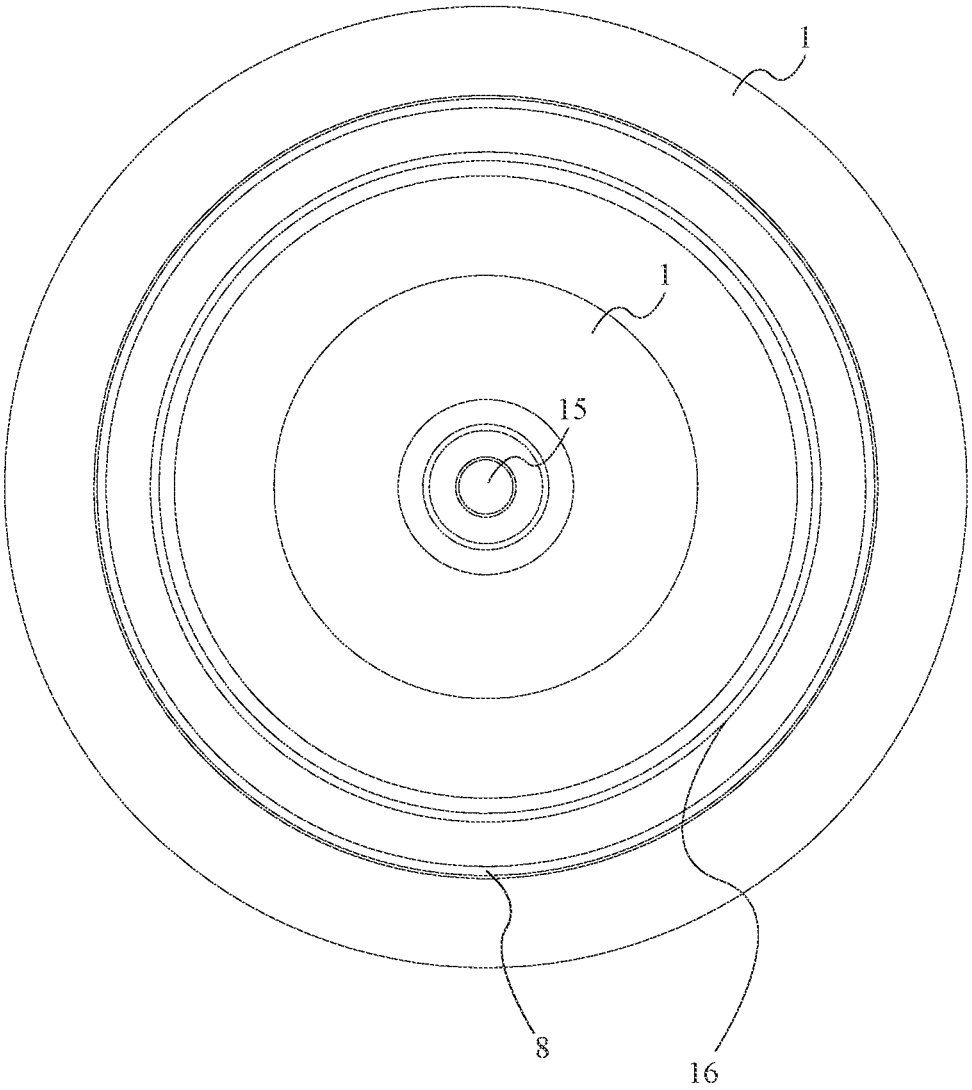
FIG. 6 is a bottom plan view of the present invention.

According to the preferred embodiment, protruding from the bottom of the main valve body 1 is the valve mounting means. The valve mounting means associates the main valve body 1 with the extraneous cylinder or gas cylinder 6. In other words, in order to accomplish mounting the present invention onto the gas cylinder 6 in a secure fashion, the connecting portion 8 comprises a plurality of retaining legs 16, and the gas cylinder 6 comprises a rounded rim 17. Preferably, the valve mounting means possesses a flexure or snap fitting means thereof that facilitates snapping and locking the vertical motion of the valve with the extraneous cylinder. Accordingly, the plurality of retaining legs 16 is positioned adjacent to the second end 1*b* of the main valve body 1. Further, the plurality of retaining legs 16 is operably coupled with the gas cylinder 6, wherein operating the plurality of legs 16 enables different stages of engagement for the main valve body 1 around the rounded rim of the gas cylinder 6. To that end, the plurality of legs 16 comprises a first stage retaining leg 16*a*, a second stage retaining leg 16*b*, and a transit retaining leg 16*c*. As seen in FIG. 3 and FIG. 4, the second stage retaining leg 16*b* is positioned between the first stage retaining leg 16*a* and the transit retaining leg 16*c*. Further, the first stage retaining leg 16*a* is positioned adjacent to the second end 1*b* of the main valve body 1, and the transit retaining leg 16*c* is positioned at a distal end of the main valve body 1. This is so that the transit retaining leg 16*c* or lower chamfer of the leg facilitates a first position that keeps the main valve body 1 at an arbitrary distance from the extraneous cylinder 6, keeping any fuel dispersal disengaged. In other words, engaging the transit retaining leg 16*c* on to the rounded rim 17 actuates a first click and this position is provided as a safety feature. The second stage retaining leg 16*b* or a second upper chamfer of the leg facilitates a second position that begins to align the spigot gas flow path 12 with the valve. Subsequently, by engaging the first stage retaining leg 16*a* around the rounded rim 17, the main valve body 1 snap fit into the gas cylinder 6, facilitating fully associating the main valve body 1 with the valve of the gas cylinder 6. Thereafter the valve system is coupled with the gas cylinder 6 and fuel dispersal may be engaged by the user. In other words, after the valve is pushed down and a third click is actuated by engaging the first stage retaining leg 16*a*, the valve system is fully engaged to the can or gas cylinder 6. This position also means the spigot valve system 4 is in a closed position.

As seen in FIG. 7, the spigot stem 9 comprises a third end 9*a* and a fourth end 9*b*, wherein the third end 9*a* is positioned opposite to the fourth end 9*b* across a length of the spigot stem 9. More specifically, the third end 9*a* constitutes a top end of the spigot stem 9 and the fourth end 9*b* constitutes a bottom end of the spigot stem 9. Preferably, the fourth end 9*b* of the spigot stem has a larger radius compared to the radius of the third end 9*a*. Further, the fourth end 9*b* is centrally mounted within the intake protrusion 7 and the third end 9*a* of the spigot stem 9 is extending away from the intake protrusion 7 as seen in FIG. 7.

Continuing with the preferred embodiment, the cap system 3 comprises a cap 18, a cap aperture 19, and a return spring 20. Preferably, the cap 18 is centrally mounted around the third end 9*a* of the spigot stem 9. As seen in FIG. 3 and FIG. 4, the cap 18 is the spherical structure that is mounted on top of the spigot stem 9. In the preferred embodiment, the cap 18 is mechanically welded onto the spigot stem 9. Further, the cap aperture 19 centrally traverses through the cap 18, wherein the cap aperture 19 is in fluid communication with the spigot gas flow path 12. This is so that when the spigot valve system 4 is open, gas in the dose volume chamber 14 can pass through the dose release orifice 10 into the spigot gas flow path 12 and through the cap aperture 19 into the external fuel utilizing device. In order to facilitate closing and opening of the spigot valve system 4 through downward vertical motion of the cap 18 and upward vertical motion through gas pressure, the return spring 20 is mounted within the cap 18. In other words, the return spring 20 is operably mounted around the third end 9*a* of the spigot stem 9, wherein the return spring 20 facilitates vertical movement of the cap 18 and the spigot valve system 4 along the intake channel 2.

Continuing with the preferred embodiment, the dose valve body 13 comprises a cylindrical region 13*a* and a flange region 13*b*. As seen in FIG. 4, and FIG. 7, the cylindrical region 13*a* is concentrically mounted around the spigot stem 9 and the intake protrusion 7. Further, the flange region 13*b* is operably engaged with the main valve body 1, wherein the flange region 13*b* restricts the removal of the spigot valve system 4 from the main valve body 1. Furthermore, as seen in FIG. 7, the dose volume seal 15 is integrated between the fourth end 9*b* of the spigot stem 9 and the intake channel 2, such that when the spigot stem 9 comes down and the valve is open, the flow of gas from the gas cylinder is stopped with the help of the dose volume seal 15, and no gas enters into the dose volume chamber 14 through the intake channel 2. Preferably, the dose volume seal 15 always moves along with the spigot stem 9, wherein the dose volume seal 15 is held in place with the gas pressure of incoming gas. Hence the dose volume seal 15 may also be called a floating seal.

Additionally, the present invention comprises a main body valve seal 21 for preventing gas leakage and enabling a tight and sealed dosing and metering process. In other words, the main body valve seal 21 is operably integrated between the dose valve body 13 and the intake protrusion 7, wherein the main body valve seal 21 mitigates fuel leakage.

In order to enable passage of gas or fuel from the intake channel 2 into the dose volume chamber 14, the present invention comprises at least one dose fill path slot 22. In the preferred embodiment, the dose fill path slot 22 is a rectangular aperture positioned adjacent to a top end of the intake protrusion 7. Thus, the dose fill path slot 22 traverses through the intake protrusion 7, and the dose fill path slot 22 is operably integrated between the gas cylinder 6 and the dosing system 5, wherein fluid enters the dose volume chamber 14 from the gas cylinder 6 through dose fill path slot 22 when the spigot valve system 4 is closed. Further, the dose fill path slot 22 is operably integrated between the dosing system 5 and the spigot valve system 4, wherein fluid enters the spigot gas flow path 12 from the dose volume chamber 14 through the dose fill path slot 22 when the spigot valve system 4 is open.

In reference to FIG. 7, when the spigot system 4 is in a closed configuration or when the first stage retaining leg 16*a* is engaged to the rounded rim 17 of the gas cylinder 6 following the third click, the gas cylinder 6 is in fluid communication with the dose volume chamber 14 through the dose fill path slot 22. In this configuration, the spigot seal 11 will be covering the dose release orifice 10, and the dose volume seal 15 will not be forming a seal between the intake channel 2 and the gas cylinder 6. In other words, in this position the gas cylinder 6 or an Al-Can is connected to the spigot valve system 4 and the gas travels through the gas cylinder 6 into the dose volume chamber 14 and remains in the dose volume chamber 14 only.

In reference to FIG. 8, when the spigot valve system 4 is in an open configuration, the dose volume chamber 14 is in fluid communication with the spigot gas flow path 12 through the dose release orifice 10, and the dose volume seal 15 forms a tight seal between the gas cylinder 6 and the intake channel 2. In this position, the cap 18 which is welded to the spigot stem 9 is pressed down, which in turn presses the spigot stem 9 on to the dose volume seal 15 or floating washer and closes the inflow of gas into dose volume chamber 14 from the gas cylinder 6. As soon as the inflow of gas stops flowing from the gas cylinder 6 to dose volume chamber 14, the gas in dose volume chamber 14 travels through dose release orifice 10 into Spigot gas flow path 12 and then into an external tool.

Figure 9:
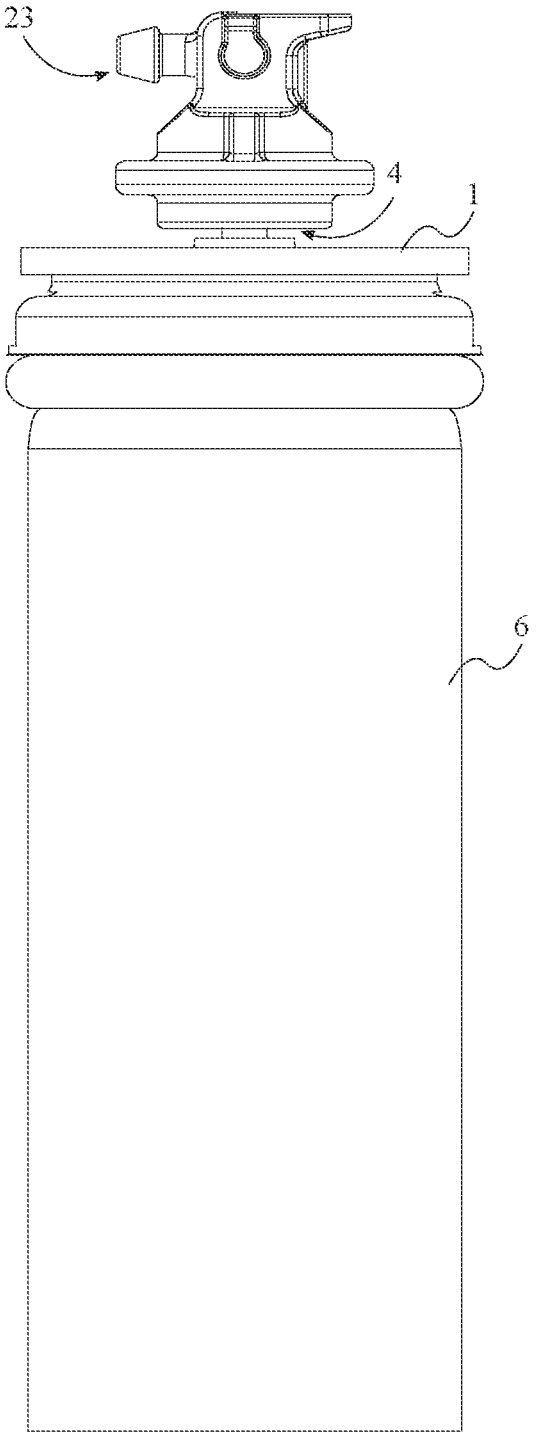
FIG. 9 is a rear elevational view of the present invention, wherein a gas cylinder and a gun actuator are also shown.

To that end, as seen in FIG. 9 and FIG. 10, the present invention comprises a gun actuator 23 or external tool. Preferably, the cap system 3 is mounted between the gun actuator 23 and the spigot valve system 4, and the gun actuator 23 is in fluid communication with the gas cylinder 6 through the spigot valve system 4. In other words, the gun actuator 23 is the external connecting tool that carries gas from the valve system to an external system that utilizes the fuel in the gas cylinder 6. Further, the gun actuator 23 pushes the cap 18 along the spigot system 4 and enables the valve system to open.

In the preferred embodiment, the present invention includes retaining means that help with fixing the linear motion of the device and restricts removal of the spigot from the apparatus.

Accordingly, in order to hold everything in place and restrict the dimensions of the dosing chamber, the present invention comprises an annular cavity 24, a retaining ring 25, and a retaining catch 26. The annular cavity 24 is a ring-shaped depression positioned around the dosing system 5, adjacent to the first end 1*a* of the main valve body 1. The retaining ring 25 comprises a snap fit or similar mechanism that permits the retaining ring 25 to snap into a locked position while affording removal thereof with sufficient force or pressure placed upon the cap retaining means. Thus, the retaining ring is positioned between the annular cavity 24 and the retaining catch 26. Further, the retaining catch 26 laterally extends into the annular cavity 24 from the main valve body 1 such that the retaining catch 26 holds the retaining ring 25 in place.

As seen in FIG. 10, the present invention comprises a cylinder to valve path 27, wherein the cylinder to valve path 27 extends into the intake channel 2. The cylinder to valve path 27 is an extension of the gas cylinder 6 that enables to guide the fuel in the valve system in a controlled fashion. Accordingly, the cylinder to valve path 27 is centrally positioned within the gas cylinder 6.

Continuing with the preferred embodiment, the present invention comprises at least one thumb recess 28. Preferably, the thumb recess 28 laterally traverses into the main valve body 1. The thumb recess 28 is an ergonomic feature that enables users to push down on the main valve body 1 as well as remove the valve system from the extraneous cylinder. In other words, the thumb recess 28 is engaged by the user to free the valve from the gas cylinder 6 by pressing until returning to the first position, thereby permitting removal of the valve system from the gas cylinder 6.

Although the invention has been explained in relation to its preferred embodiment, it is to be understood that many other possible modifications and variations can be made without departing from the spirit and scope of the invention.

What is claimed is:

1. A controlled dosage dispensing valve system comprising:

a main valve body;

an intake channel;

a cap system;

a spigot valve system;

a dosing system;

a gas cylinder;

the main valve body comprising an intake protrusion, a connecting portion, a first end, and a second end;

the spigot valve system comprising a spigot stem, at least one dose release orifice, a spigot seal, and a spigot gas flow path;

the dosing system comprising a dose valve body, a dose volume chamber, and a dose volume seal;

the first end being positioned opposite to the second end across the main valve body;

the intake protrusion being centrally positioned and extending opposite to the second end of the main valve body;

the intake channel traversing centrally through the intake protrusion;

the gas cylinder being in fluid communication with the intake channel;

the connecting portion being mounted adjacent to the second end of the main valve body;

the spigot valve system and the dosing system being centrally mounted around the intake protrusion;

the cap system being operably coupled with the spigot valve system and the dosing system, wherein operating the cap system enables the spigot valve system to transition between a closed state and an open state;

the spigot stem extending above the intake protrusion away from the first end of the main valve body;

the spigot gas flow path centrally traversing through the spigot stem;

the at least one dose release orifice laterally traversing through the spigot stem;

the spigot seal concentrically wrapped around the spigot stem adjacent to the at least one dose release orifice;

the dose volume chamber being delineated by the area between the dose valve body and the intake protrusion; and the dose volume seal being operably connected within the intake channel, wherein operating the spigot system enables the dose volume seal to close and open the flow of gas from the gas cylinder into the dose volume chamber.

2. The controlled dosage dispensing valve system of claim 1, comprising:

the main valve body comprising a plurality of retaining legs;

the gas cylinder comprising a rounded rim;

the plurality of retaining legs being positioned adjacent to the second end of the main valve body; and the plurality of retaining legs being operably coupled with the gas cylinder, wherein operating the plurality of retaining legs enables different stages of engagement for the main valve body around the rounded rim of the gas cylinder.

3. The controlled dosage dispensing valve system of claim 2, comprising:

each of the plurality of retaining legs comprising a first stage retaining leg, a second stage retaining leg, and a transit retaining leg;

the second stage retaining leg being positioned between the first stage retaining leg and the transit retaining leg;

the first stage retaining leg being positioned adjacent to the second end of the main valve body; and the transit retaining leg being positioned at a distal end of the main valve body.

4. The controlled dosage dispensing valve system of claim 1, comprising:

the spigot stem comprising a third end and a fourth end, wherein the third end is positioned opposite to the fourth end across a length of the spigot stem;

the fourth end of the spigot stem being centrally mounted within the intake protrusion; and the third end of the spigot stem extending away from the intake protrusion.

5. The controlled dosage dispensing valve system of claim 4, the cap system comprising:

a cap, a cap aperture, and a return spring;

the cap being centrally mounted around the third end of the spigot stem;

the cap aperture centrally traversing through the cap;

the cap aperture being in fluid communication with the spigot gas flow path;

the return spring being mounted within the cap; and the return spring being operably mounted around the third end of the spigot stem, wherein the return spring facilitates vertical movement of the cap and the spigot valve system along the intake channel.

6. The controlled dosage dispensing valve system of claim 4, the dosing system comprising:

the dose valve body comprising a cylindrical region and a flange region;

the cylindrical region being concentrically mounted around the spigot stem and the intake protrusion;

the flange region being operably engaged with the main valve body, wherein the flange region restricts the removal of the spigot valve system from the main valve body; and the dose volume seal being integrated between the fourth end of the spigot stem and the intake channel.

7. The controlled dosage dispensing valve system of claim 1, comprising:

a main body valve seal; and the main body valve seal being operably integrated between the dose valve body and the intake protrusion, wherein the main body valve seal mitigates fuel leakage.

8. The controlled dosage dispensing valve system of claim 1, wherein the spigot valve system is in a closed configuration:

the gas cylinder being in fluid communication with the dose volume chamber through a dose fill path slot;

the spigot seal covering a spigot aperture; and the dose volume seal does not form a seal between a intake aperture and the gas cylinder.

9. The controlled dosage dispensing valve system of claim 8, wherein the spigot valve system is in an open configuration:

the dose volume chamber being in fluid communication with the spigot gas flow path through the spigot aperture; and the dose volume seal forming a tight seal between the gas cylinder and the intake aperture.

10. The controlled dosage dispensing valve system of claim 1, comprising:

a gun actuator;

the cap system being mounted between the gun actuator and the spigot valve system; and the gun actuator being in fluid communication with the gas cylinder through the spigot valve system.

11. The controlled dosage dispensing valve system of claim 1, comprising:

an annular cavity;

a retaining ring;

a retaining catch;

the annular cavity traversing into the main valve body;

the retaining ring being positioned between the annular cavity and the retaining catch; and the retaining catch laterally extending into the annular cavity from the main valve body.

12. The controlled dosage dispensing valve system of claim 1, wherein the dose volume seal is held in place with the gas pressure of the incoming gas.

13. The controlled dosage dispensing valve system of claim 1, comprising:

a cylinder to valve path;

the cylinder to valve path extending into the intake channel; and the cylinder to valve path being centrally positioned within the gas cylinder.

14. The controlled dosage dispensing valve system of claim 1, comprising:

at least one dose fill path slot;

the at least one dose fill path slot traversing through the intake protrusion;

the at least one dose fill path slot being operably integrated between the gas cylinder and the dosing system, wherein fluid enters the dose volume chamber from the gas cylinder through the at least one dose fill path slot when the spigot valve is closed; and the at least one dose fill path slot being operably integrated between the dosing system and the spigot valve system, wherein the fluid enters the spigot gas flow path from the dose volume chamber through the at least one dose fill path slot when the spigot valve is open.

15. The controlled dosage dispensing valve system of claim 1, comprising:

at least one thumb recess; and the at least one thumb recess laterally traversing into the main valve body.

16. The controlled dosage dispensing valve system of claim 1, comprising:

a gun actuator;

the cap system being mounted between the gun actuator and the spigot valve system; and the gun actuator being in fluid communication with the gas cylinder through the spigot valve system;

a cylinder to valve path;

the cylinder to valve path extending into the intake channel; and the cylinder to valve path being centrally positioned within the gas cylinder;

at least one dose fill path slot;

the at least one dose fill path slot traversing through the intake protrusion;

the at least one dose fill path slot being operably integrated between the gas cylinder and the dosing system, wherein fluid enters the dose volume chamber from the gas cylinder through the at least one dose fill path slot when the spigot valve is closed;

the dose fill path slot being operably integrated between the dosing system and the spigot valve system, wherein the fluid enters the spigot gas flow path from the dose volume chamber through the at least one dose fill path slot when the spigot valve is open;

at least one thumb recess; and the at least one thumb recess laterally traversing into the main valve body.

17. A controlled dosage dispensing valve system comprising:

a main valve body;

an intake channel;

a cap system;

a spigot valve system;

a dosing system;

a gas cylinder;

the main valve body comprising an intake protrusion, a connecting portion, a first end, and a second end;

the spigot valve system comprising a spigot stem, at least one dose release orifice, a spigot seal, and a spigot gas flow path;

the dosing system comprising a dose valve body, a dose volume chamber, and a dose volume seal;

the connecting portion comprising a plurality of retaining legs;

the gas cylinder comprising a rounded rim;

the first end being positioned opposite to the second end across the main valve body;

the intake protrusion being centrally positioned and extending opposite to the second end of the main valve body;

the intake channel traversing centrally through the intake protrusion;

the gas cylinder being in fluid communication with the intake channel;

the connecting portion being mounted adjacent to the second end of the main valve body;

the spigot valve system and the dosing system being centrally mounted around the intake protrusion;

the cap system being operably coupled with the spigot valve system and the dosing system, wherein operating the cap system enables the spigot valve system to transition between a closed state and an open state;

the spigot stem extending above the intake protrusion away from the first end of the main valve body;

the spigot gas flow path centrally traversing through the spigot stem;

the at least one dose release orifice laterally traversing through the spigot stem;

the spigot seal concentrically wrapped around the spigot stem adjacent to the at least one dose release orifice;

the dose volume chamber being delineated by the area between the dose valve body and the intake protrusion;

the dose volume seal being operably connected within the intake channel, wherein operating the spigot system enables the dose volume seal to close and open the flow of gas from the gas cylinder into the dose volume chamber;

wherein the dose volume seal is held in place with the gas pressure of the incoming gas; and the plurality of retaining legs being operably coupled with the gas cylinder, wherein operating the plurality of retaining legs enables different stages of engagement for the main valve body around the rounded rim of the gas cylinder.

18. The controlled dosage dispensing valve system of claim 17, comprising:

the spigot stem comprising a third end and a fourth end, wherein the third end is positioned opposite to the fourth end across a length of the spigot stem;

the fourth end of the spigot stem being centrally mounted within the intake protrusion;

the third end of the spigot stem extending away from the intake protrusion;

a main body valve seal;

the main body valve seal being operably integrated between the dose valve body and the intake protrusion, wherein the main body valve seal mitigates fuel leakage;

wherein the spigot valve system is in a closed configuration:

the gas cylinder being in fluid communication with the dose volume chamber through dose fill path slot;

the spigot seal covering the spigot aperture; and the dose volume seal does not form a seal between the intake aperture and the gas cylinder.

19. The controlled dosage dispensing valve system of claim 17, the cap system comprising:

a cap, a cap aperture, and a return spring;

the cap being centrally mounted around the third end of the spigot stem;

the cap aperture centrally traversing through the cap;

the cap aperture being in fluid communication with the spigot gas flow path;

the return spring being mounted within the cap;

the return spring being operably mounted around the third end of the spigot stem, wherein the return spring facilitates vertical movement of the cap and the spigot valve system along the intake channel;

wherein the spigot valve system is in an open configuration:

the dose volume chamber being in fluid communication with the spigot gas flow path through the spigot aperture; and the dose volume seal forming a tight seal between the gas cylinder and the intake aperture.

20. The controlled dosage dispensing valve system of claim 17, the dosing system comprising:

the dose valve body comprising a cylindrical region and a flange region;

the cylindrical region being concentrically mounted around the spigot stem and the intake protrusion;

the flange region being operably engaged with the main valve body, wherein the flange region restricts the removal of the spigot valve system from the main valve body;

the dose volume seal being integrated between the fourth end of the spigot stem and the intake channel;

an annular cavity;

a retaining ring;

a retaining catch;

the annular cavity traversing into the main valve body;

the retaining ring being positioned between the annular cavity and the retaining catch; and the retaining catch laterally extending into the annular cavity from the main valve body.

* * * * *